United States Patent [19]

Bögner et al.

[11] Patent Number: 4,604,597

[45] Date of Patent: Aug. 5, 1986

[54] SOLENOID SWITCH SUITABLE FOR MOTOR STARTERS

[75] Inventors: Karl-Heinz Bögner, Neuhausen; Klaus Bolenz, Schwieberdingen, both of Fed. Rep. of Germany

[73] Assignee: Robert Bosch GmbH, Stuttgart, Fed. Rep. of Germany

[21] Appl. No.: 712,912

[22] Filed: Mar. 15, 1985

Related U.S. Application Data

[63] Continuation of Ser. No. 515,611, Jul. 20, 1983, abandoned.

[30] Foreign Application Priority Data

Jul. 30, 1982 [DE] Fed. Rep. of Germany ... 8221714[U]

[51] Int. Cl.[4] ..... H01H 67/02

[52] U.S. Cl. ..... 335/127; 335/131

[58] Field of Search ..... 335/127, 131, 132, 133, 335/186; 200/332, 335

[56] References Cited

U.S. PATENT DOCUMENTS

| | | | |
|---|---|---|---|
| 2,561,450 | 7/1951 | Russell | 335/131 X |
| 3,430,165 | 2/1969 | Mussbach | 335/131 |
| 3,815,060 | 6/1974 | Turnbull | 335/131 X |
| 4,450,423 | 5/1984 | Morishita | 335/131 |

FOREIGN PATENT DOCUMENTS

| | | | |
|---|---|---|---|
| 2488041 | 2/1982 | France | 335/131 |
| 2018030 | 10/1979 | United Kingdom | 335/131 |

*Primary Examiner*—George Harris

*Attorney, Agent, or Firm*—Frishauf, Holtz, Goodman & Woodward

[57] ABSTRACT

A contact rod (19) carrying the contact bridge (25) for the starting current contacts of an engine starter circuit has, at its end inserted in the armature (15) of the solenoid a stop (21 and 23) against which the return spring (33) bears and which also serves to guide the switch rod within the armature. The return spring forces the component group, including the switch rod and the contact bridge, to move with the armature. This component group is readily assembled automatically in manufacture. After the excitation winding is deenergized, the armature, switch rod and contact bridge are moved back into the rest position by the full force of the return spring so that any sticking or welding of the contact bridge to the main current contacts is loosened, and damage therefrom prevented.

10 Claims, 3 Drawing Figures

SOLENOID SWITCH SUITABLE FOR MOTOR STARTERS

This application is a continuation, of application Ser. No. 515,611, filed July 20, 1983 abandoned.

This invention concerns an electromagnetic switch operating on the solenoid principle and commonly referred to simply as the "solenoid" when used in the engine starter circuit of a motor vehicle.

In such a switch, a switch rod is mounted displaceably with respect to the magnet armature which itself is mounted so as to be drawn in or pushed out of the solenoid coil. When the armature moves into the coil, the switch rod moves with it only after the armature has already executed a part of its inward movement. If after successful starting of the engine the starting system is switched off, a return spring pushes the magnet armature back into its rest position.

In solenoid switches of the kind just described, there is the disadvantage that when the magnet armature is brought back into its rest position by the return spring after the starting pinion has been disengaged by the starting gearing, the switch rod does not at once follow the movement of the armature. If the contact bridge held by the switch rod adheres or welds to the starting current contacts (which may be referred to as the main current contacts), the force of the return spring is not sufficient to pull the contact bridge loose from the contacts. The main current contacts remain connected by the contact bridge, the starting motor continues to be connected to the current source and runs along without the driver noticing its continued operation, and both the starting motor and the electromagnetic switch are likely to be damaged. The switch rod is accordingly equipped with supplementary switch operating means for compelled return of the switch rod and with it the contact bridge, into rest position. There is also known an electromagnetic switch in which the switch rod is fixed to the armature. This has the disadvantage that the assembly of the subgroup of parts constituted by the switch rod and contact bridge with the armature does not lehd itself well to economical large-scale manufacture. Even in disassembly for adjustment and repair purposes, parts of this component group risk being unnecessarily damaged or destroyed in this case.

SUMMARY OF THE INVENTION

It is an object of the present invention to provide a solenoid switch in which sticking of the contact bridge to the starting current contacts will be substantially prevented without incurring the disadvantages of fastening the switch rod to the armature.

Briefly, the switch rod has one end inserted in a bore of the armature at which end it is provided with a stop for abutment of a return spring and which guides the switch rod in the bore of the armature.

The invention basically has the advantage that the return movement of the readily assembled and maintained component group consisting of switch rod, contact bridge carrier, contact bridge and contact pressure spring into their rest position after switching off of the starter circuit, is moved by the full force of the return spring, causing the switch rod to go along with the magnet armature for its full path. The pulling loose of the contact bridge is thereby facilitated and accelerated, because the break-away of the contact bridge occurs immediately with the rearward movement of the armature, so that an additional return guide spring can be omitted. The return spring then holds both the armature and the switch rod component group in their quiescent positions. The construction of the solenoid of the present invention has further features set forth in the detailed description below which facilitate automatic assembly of the switch rod and contact bridge subassembly, together With the armature, in a manner that maintains the switch rod against the armature in shakeproof fashion.

The Drawings. The invention is further described by way of illustrative example with reference to the annexed drawings, in which.

DESCRIPTION OF THE ILLUSTRATED EMBODIMENTS

Figure 1:
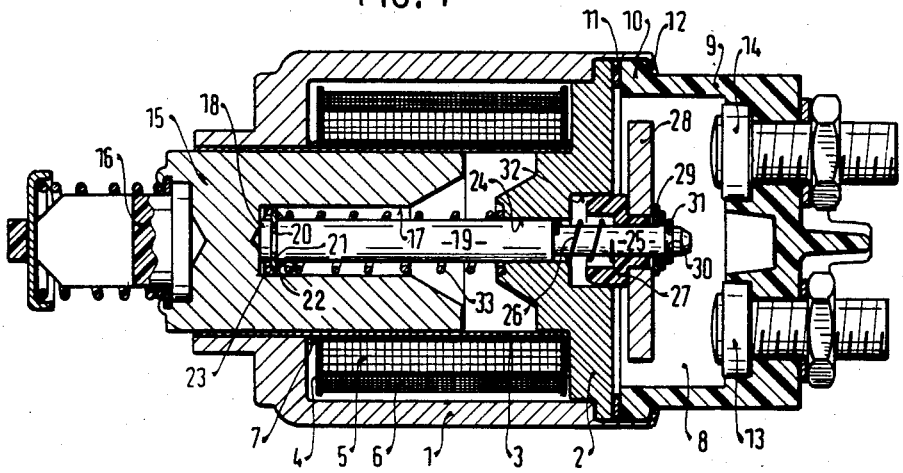
FIG. 1 is a longitudinal section, with some rods and contacts in elevation, of a first embodiment of solenoid switch according to the invention.

As shown in FIG. 1, a solenoid switch has a pot-shaped casing 1 that serves at the same time as the return circuit yoke for the magnetic circuit of the switch. A magnet core 2 is mounted at the open end of the casing 1. On an offset of the core 2, a brass sleeve 3 is seated that has its other end in a bore in the bottom of the casing 1. A winding support 4 is mounted on the brass sleeve 3, and an excitation winding is provided on the support 4, this winding consisting of a pull-in winding 5 and a hold winding 6. A spring 7 is set between the bottom of the casing 1 and the support 4, in order to hold the support 4 shakeproof in the casing 1 while equalizing dimensional variations resulting from manufacturing tolerances.

The external face of the magnet core 2 forms a boundary of a switching space or chamber 8 enclosed by a cap 9. The cap 9 has a flange 10 at its rim facing the core 2. Between the core 2 and the cap rim, a spring element 11 is inserted. A fastening rim 12 of the casing 1 hooks over the edge of the core 2 and the flange 10, being bent over behind the flange 10.

Two main current contacts 13 and 14 are fastened in the cap 9 which project into the switching chamber 8 and have terminal studs leading out of the cap 9 which are connected in a known way, not shown in the drawing, respectively to the positive terminal of a battery and to the field winding of a starter motor.

A magnet armature 15 is guided in a shakeproof manner within the brass sleeve 3. At its end projecting out of the sleeve 3 and therefore also out of the casing 1, there is connected to the magnet armature 15 the driving arm 16 for the engagement lever, not further shown in the drawing, of a starter gear system. The armature 15 has a blind bore 17 facing the magnet core 2. In this bore, one end 18 of a switch rod 19 is inserted and guided. Near its end 18, the switch rod 19 is provided with an annular groove 20 in which a spreading ring 21 is snapped to act as a stop. A saucer-shaped guide piece 22 is seated on the switch rod 19 and bears against the snap ring 21. The rim 23 of the guide piece 22 grasps around the snap ring 21 and is guided in the blind bore 17 of the armature 15. The switch rod 19 is made either of metal or of a tough synthetic plastic, for example a polyamide available with designation Ultramide (International registered Trademark of Badische Anilin- und Sodafabrik AG).

The switch rod 19 is guided at its other end a longitudinal bore 24 passing through the core 2. Its end section 25, which is of smaller diameter than the portion guided in the bore 24, projects into the switching chamber 8. A contact pressure spring 26, a contact bridge carrier 27 of insulating material which carries a contact bridge 28, an insulating disk 29 and a stop ring 3 seated in a ring groove 30 are disposed on the end section 25 of the switch rod 19. In the quiescent position of the solenoid switch, the contact bridge carrier 27 is seated in a widened end portion of the bore 24 of the magnet core 2.

A return spring 33 is mounted on the switch rod 19. It lies with one end abutting the guide piece 22 and with its other end bears against the magnet core 2. The return spring 33 holds the component group made up of the switch rod 19, contact pressure spring 26, contact bridge carrier 27, and contact bridge 28 as well as magnet armature 15 in the quiescent position illustrated in the drawing. The switch rod 19 is thus pressed by the return spring 33 against the bottom of the blind bore 17.

When the winding 5,6 is energized, the armature 15 is drawn against the magnet core 2 in order to engage the starter pinion not shown in the drawing of the starter gear system already mentioned, by means of the engaging lever, likewise not shown, which is linked to the driving arm 16 attached to the armature 15, all this against the force of the return spring 33 which builds up force as it is compressed. In this operation, the sWitch rod 19, abutting the bottom of the blind bore 17, is immediately moved along by the armature 15, moving it further into the switching chamber 8. The contact bridge 28 mounted on the contact bridge carrier 27 is pressed against the main current contacts 13 and 14, with support of the contact pressure spring 26 by the movement of the switch rod 19 into the switching chamber 8. In consequence, the starter motor not shown in the drawing, which is connected to the terminal stud of the main current contact 13, becomes cOnnected in the usual way with the current source, likewise not shown, that is connected to the terminal stud of the main current contact 14. The starter motor receives current to start the engine.

As soon as the engine has started, the current supply to the excitation winding of the solenoid switch is shut off. The armature 15 is pushed away from the magnet core 2 by the return spring 33. In this operation, the spring 33 bears directly against the guide piece 22 which bears against the snap ring 21 of the switch rod 19 and pushes the switch rod 19 together with the armature 15 back into the quiescent position. The switch rod 19 pulls along the contact bridge carrier 27 with the contact bridge 28 by means of the stop ring 31, so that the contact bridge 28 is pulled off the main current contacts 13 and 14, the current supply from the current source to the starter motor is interrupted and the starter motor stops. Since the full force of the return spring 33 operates on the switch rod 19 when the armature 15 is pushed back, the contact bridge 28 is torn loose from the main current contacts 13 and 14 even when sticking or welding occurs. Armature 15 and switch rod 19 are forced to move together, even though the rod 19 is not fastened to the armature 15 but is only inserted in the blind bore 17 of the armature. The return spring 33 continuously holds the switch rod 19 against the bottom of the blind bore 17 by bearing against the guide piece 22. Furthermore, the guide piece 22, by means of its rim 23, holds the switch rod 19 adequately shakeproof in the blind bore 17 of the armature 15.

Figure 2:
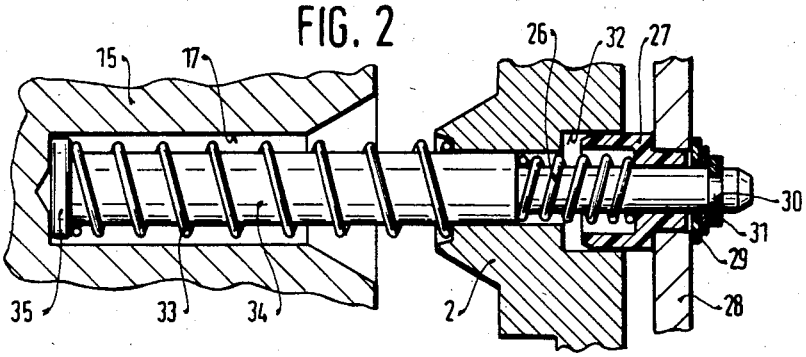
FIG. 2 is a similar section, on a magnified scale, of a part of a second embodiment of solenoid switch according to the invention.

A second embodiment of the solenoid switch of the invention is shown in FIG. 2. To the extent that parts are the same as those of FIG. 1, they have the same reference numerals.

In FIG. 2 there is inserted in the blind bore 17 of the armature 15 a switch rod 34 of which the end bearing on the bottom of the blind bore 17 is shaped to provide a stop 35 against which the return spring 33 bears and which at the same time operates as a guide for the switch rod 34 within the armature 15. When the switch rod 34 is made of metal, the stop 35 can be made as a flange by upsetting. When the switch rod 34 is of synthetic plastic, the stop 35 can be made as an integral flange by injection molding.

Figure 3:
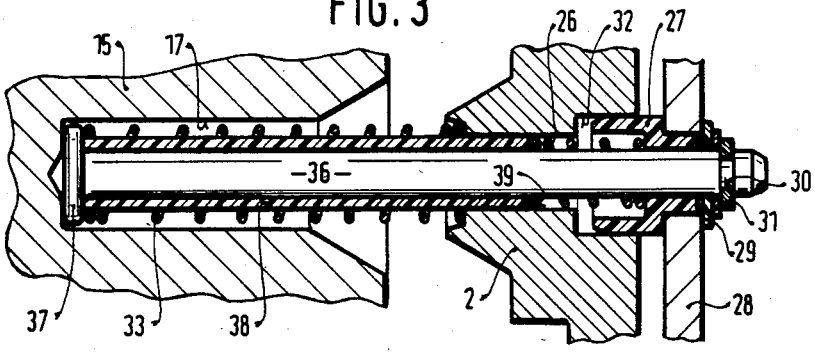
FIG. 3 is a similar sectional view of a modification of the embodiment illustrated in FIG. 2.

FIG. 3 shows a modification of the switch rod 34 of FIG. 2. Insofar as the parts are the same as those in FIGS. 1 and 2, they have the same reference numerals.

In FIG. 3, a switch rod 36 made of metal, which is inserted in the blind bore 17 Of the armature 15, has an upset end 37 serving as a stop for the return spring 33 as well as providing a guide for the rod 36 in the armature 15. In operation of a motor vehicle under rough conditions, it can occur that the return spring 33 can score the switch rod 36, the latter is covered by a close-fitting sleeve o shell 38 made of a tough thermoplastic material, such as glass-fiber-reinforced polyamide (preferably ultramide). The she 38 extends from the stop 37 all the way to the section of the switch rod 36 guided in the longitudinal bore 24 of the core 2. The shell 38 provides at its end 39 the stop for the end of the contact pressure spring 26, the other end of which bears against the contact bridge carrier 27.

Although the invention has been described with reference to three illustrative embodiments, it will be understood that further variations and modifications are possible within the inventive concept.

We claim:

1. Solenoid switch suitable for starter circuits for internal combustion engines, having a casing of ferromagnetic material, a nonmagnetic guiding sleeve therein, an excitation winding mounted on said sleeve with a winding support, a magnet armature guided in said sleeve, a magnet core disposed at an open end of said casing against which said magnet armature is attractable magnetically against the force of a return spring bearing against said magnet core, a contact bridge carrier (28) guided movably in said magnet core by means of a longitudinally movable switch rod having a first end near which said carrier is mounted thereon, and having also a second end opposite the first, said switch rod extending through an aperture in said magnet core, said carrier being displaceable away from a stop therefor on said first end of said switch rod against the force of a contact pressure spring, said switch rod together with said contact bridge carrier seating a contact bridge in a switching space covered by a cap in which two main current contacts are disposed which project into the switching space, said solenoid switch further embodying the improvement which comprises:

stop means (21; 35; 37), against which said return spring bears, located at said second end of said switch rod (19; 34; 36), said magnet armature (15) having a bore (17) in which said second siwtch-rod end is inserted, said stop means having a configuration for centering said switch rod second end in said bore, said contact bridge carrier (28) being thus subject to be pulled away form said two main contacts (13, 14) solely by the force of said return spring (33) immediately upon interruption of current flow in said winding and said return springs (33) thereby able to apply its full force simultaneously to both said switch rod (19) and said armature (15) for returning them both while in mutual abutement in a concurrent movement in which they travel equal distance to their respective rest positions.

2. Solenoid switch according to claim 1, in which said stop means on said second end of said switch rod (19) comprises a stop ring (21) carried by said switch near its said second end and a guide part (22) pressed against said stop ring against which said return spring (33) bears, said guide part (22) having a section (23) running parallel to the longidutinal axis of said switch rod (19) for centering said switch rod in said bore (17) of said armature (15).

3. Solenoid switch according to claim 1, in which said stop means are constituted by a flange (35; 37) at said second end of said switch rod (34; 36), against one end of said return spring (33) bears, said flange also serving to center said switch rod in said magnet armature (15)

4. Solenoid switch according to claim 1, in which said switch rod (19; 34; 36) is of metal.

5. Solenoid switch according to claim 2, in which said switch rod (19; 34; 35) is of metal.

6. Solenoid switch according to claim 3, in which said switch rod (19; 34; 36) is of metal.

7. Solenoid switch according to claim 1, in which said switch ro (34) is made of insulating synthetic plastic.

8. Solenoid switch according to claim 3, in which said switch rod (34) is made of insulating synthetic plastic.

9. Solenoid switch according to claim 3, in which said switch rod (36) is of metal and at least in the region of said return spring (33) is encased in a sleeve (38) of synthetic plastic which abuts at one end against said flange (37).

10. Solenoid switch according to claim 9, in which the end (39) of said sleeve (38) remote from said flange (37) bears against said contact pressure spring (26).

* * * * *